United States Patent [19]

Colvin

[11] Patent Number: 4,598,616

[45] Date of Patent: Jul. 8, 1986

[54] WRENCH OPENING

[76] Inventor: David S. Colvin, 23933 Haynes, Farmington Hills, Mich. 48018

[21] Appl. No.: 777,237

[22] Filed: Sep. 18, 1985

[51] Int. Cl.[4] ..... B25B 13/06

[52] U.S. Cl. ..... 81/124.6; 81/124.3

[58] Field of Search ..... 81/121.1, 124.3, 124.6, 81/124.7

[56] References Cited

U.S. PATENT DOCUMENTS

| | | | |
|---|---|---|---|
| 736,687 | 8/1903 | Chandler . | |
| 1,954,141 | 4/1934 | Miquelon . | |
| 2,652,735 | 9/1953 | Wilder . | |
| 2,685,219 | 8/1954 | Diebold . | |
| 2,692,522 | 10/1954 | Reyner . | |
| 3,125,910 | 3/1964 | Kavalar | 81/124.3 |
| 3,242,775 | 3/1966 | Hinkle . | |
| 3,466,956 | 9/1969 | Bowers . | |
| 3,495,485 | 2/1970 | Knudsen et al. . | |
| 3,577,817 | 5/1971 | Jennings . | |
| 3,695,124 | 10/1972 | Myers | 81/124.3 |
| 3,903,764 | 9/1975 | Andersen . | |
| 3,908,488 | 9/1975 | Andersen . | |
| 4,253,353 | 3/1981 | Symbol . | |
| 4,512,220 | 4/1985 | Barnhill, III et al. . | |

*Primary Examiner*—James G. Smith

*Attorney, Agent, or Firm*—Brooks & Kushman

[57] ABSTRACT

A wrench opening (14,14') is disclosed as having particular utility for use with a socket (10) or closed end wrench (34) and includes inwardly convex engagement surfaces (16) defining a closed shape and having continuously curved end portions (**16*a*,16*b*) that provide greater surface-to-surface engagement with a nut or bolt head to be torqued than is possible with conventional flat engagement surface portions. The curvature of the engagement surfaces (16) is selected to provide maximum surface-to-surface engagement when normal tolerance deviations are involved. Connecting surfaces (20 or 22) extending between the engagement surfaces (16**) are constructed to provide improved stress distribution and reduced tooling cost.

17 Claims, 9 Drawing Figures

WRENCH OPENING

TECHNICAL FIELD

This invention relates to a wrench opening that has particular utility when used with a socket or closed end wrench.

BACKGROUND ART

Closed wrench openings conventionally include planar engagement surfaces for engaging each side of a nut or bolt head to be torqued. Usually such planar engagement surfaces are arranged in either a hexagonal arrangement that is conventionally referred to as a six point opening or are arranged in a double hexagonal arrangement that is conventionally referred to as a twelve point opening. In either case, tolerances adopted by wrench manufacturers and by manufacturers of nuts and bolts result in some spacing between the planar engagement surfaces of a wrench opening and the sides of a nut or bolt head to be torqued. Such spacing results in a certain amount of "free swing" that will vary depending upon the particular size of each wrench opening and the size of the nut or bolt head received by the opening. The net result is that there is normally a line contact between the linear side junctions of a nut or bolt head and the planar engagement surfaces of a wrench opening applying the torque. This line contact amplifies the stress applied to the nut or bolt head and thereby results in deformation and less torquing ability than would be the case if the stress were distributed by surface-to-surface engagement.

In an attempt to overcome the above mentioned problems, prior closed wrench openings have included angularly oriented planar engagement surface portions whose angularity is selected in attempt to provide a surface-to-surface engagement with the nut or bolt head when the mean tolerance spacing is present. However, a greater or lesser extent of spacing will still result in the line contact that distorts the nut or bolt head and prevents a greater application of torque than would be possible with surface-to-surface engagement. Prior art patents which disclose closed wrench openings having angularly oriented planar engagement surface portions include U.S. Pat. Nos.: 3,242,775 Hinkle; 3,466,956 Bowers; 3,495,485 Knudsen et al; 3,903,764 Andersen; 3,908,488 Andersen; and 4,512,220 Barnhill, III, et al.

Other wrenches noted during the investigation involving the present invention are disclosed by U.S. Pat. Nos.: 736,687 Chandler; 1,954,141 Miquelon; 2,652,735 Wilder; 2,685,219 Diebold; 2,692,522 Reyner; 3,577,817 Smith; and 4,253,353 Symbol.

DISCLOSURE OF INVENTION

An object of the present invention is to provide an improved closed wrench opening that is capable of applying a greater amount of torque than conventional closed wrench openings without deforming the nut or bolt head being torqued and which also has a construction that provides improved stress distribution and reduced tooling cost.

In carrying out the above object, the invention is incorporated in a wrench body having a wrench opening with a central axis about which rotation takes place during torquing of a nut or bolt head. The wrench opening has a plurality of engagement surfaces that define a closed shape and face inwardly toward the central axis. Each of the engagement surfaces has an inwardly convex shape and includes opposite end portions that are continuously curved with the same curvature as each other. This construction of the wrench opening provides greater surface-to-surface engagement with nuts or bolt heads to be torqued than is possible with engagement surfaces having flat surface portions.

The engagement surfaces of the wrench have curvatures including central portions spaced from the central axis by a radius $R_1$ and the curvature of each engagement surface has a radius $R_2$ with the relationship of $R_1$ being in the range of about 0.06 $R_2$ to 0.40 $R_2$. Most preferably, $R_1$ is about 0.2 $R_2$ to provide optimal results in providing surface-to-surface engagement in torquing of nuts or bolt heads despite tolerance variations that necessarily are present.

The preferred construction of the wrench opening also includes connecting surfaces extending between the adjacent end portions of adjacent engagement surfaces. These connecting surfaces are constructed in order to provide improved stress distribution and reduced tooling cost.

In one embodiment, the connecting surfaces of the wrench opening extend between the engagement surfaces in a tangential relationship to the engagement surfaces. Each of these connecting surfaces preferably has a curvature with a radius $R_3$ in the range of about 0.08 $R_1$ to 0.24 $R_1$. The most preferred size of the connecting surface radius $R_3$ is about 0.16 $R_1$. With the connecting surfaces having this construction, tools utilized to form the wrench opening can wear a much greater extent than is possible with conventional wrench opening tooling before replacement thereof is necessary.

In another embodiment, the connecting surfaces of the wrench opening extend between the engagement surfaces and each connecting surface has a curvature with a radius $R_4$ having a center at the central axis of the opening. This construction of the connecting surfaces allows the tools utilized to form the wrench opening to be manufactured by turning about the central axis in an economical manner.

Two different versions of the wrench opening are disclosed. In one version, the wrench body has each engagement surface provided with a central portion extending between the end portions thereof and the wrench opening has six engagement surfaces extending about the central axis. In another version, each engagement surface has a recess between the end portions thereof with each of these recesses receiving a pair of adjacent end portions of the other engagement surfaces such that the wrench opening has twelve of the engagement surfaces spaced about the central axis.

All of the embodiments and versions of the wrench opening have particular utility when incorporated in a wrench socket including a driver opening that drives the wrench body or when incorporated in a closed end wrench having a handle with one end including the closed end wrench body defining the wrench opening.

The objects, features, and advantages of the present invention are readily apparent from the following detailed description of the best modes for carrying out the invention when taken in connection with the accompanying drawings.

BEST MODES FOR CARRYING OUT THE INVENTION

With reference to FIGS. 1 through 4, a socket indicated generally by 10 includes a unitary wrench body 12 having a wrench opening 14 that is constructed in accordance with the present invention and has a central axis A extending through the wrench opening and the rest of the socket. The wrench opening 14 includes a plurality of engagement surfaces 16 defining a closed shape and facing inwardly toward the central axis A. Each of the engagement surfaces 16 has an inwardly convex shape and includes opposite end portions **16*a* and 16*b* (FIG. 5**) that are continuously curved with the same curvature as each other.

Figure 1:
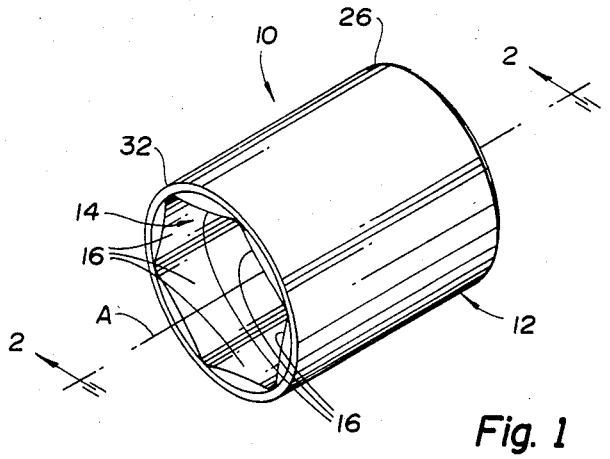
FIG. 1 is a perspective view of a socket including a wrench opening constructed in accordance with the present invention.
Figure 2:
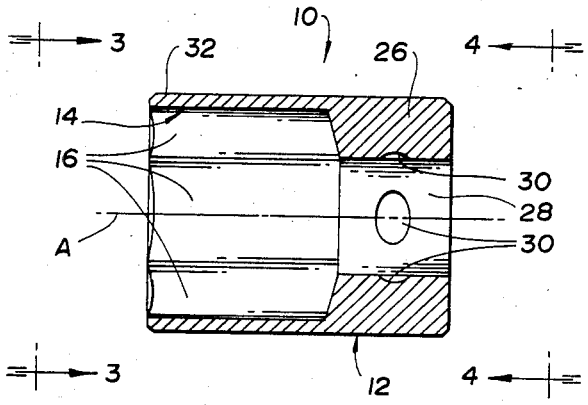
FIG. 2 is a sectional view taken through the socket along the direction of line 2—2 in FIG. 1.
Figure 3:
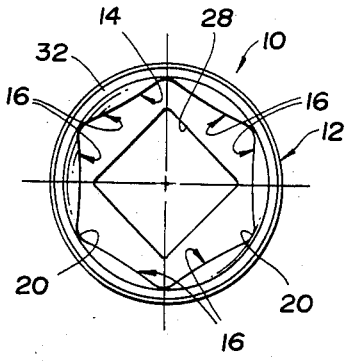
FIG. 3 is a front axial view of the socket taken along the direction of line 3—3 in FIG. 2.
Figure 4:
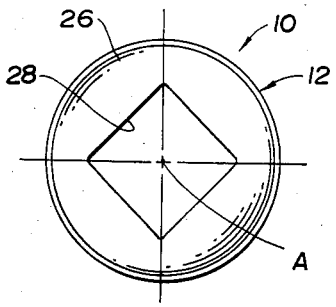
FIG. 4 is a rear axial view of the socket taken along the direction of line 4—4 in FIG. 2.
Figures 5, 6, 7, 8, 9:
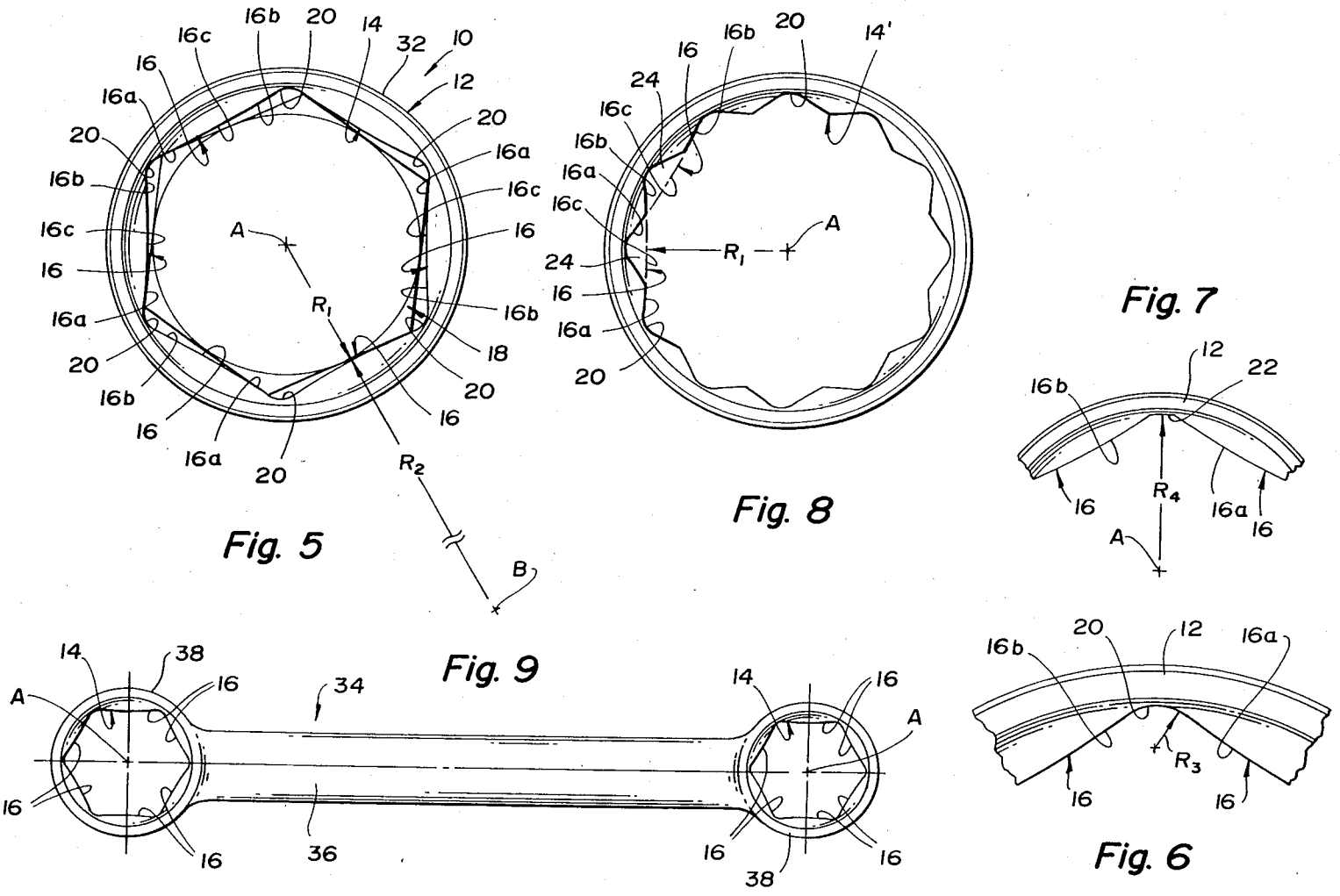
FIG. 5 is an enlarged view of FIG. 3 illustrating the manner in which the wrench opening is constructed to provide surface-to-surface contact with a nut or bolt head being torqued.
FIG. 6 is a partial view illustrating one embodiment of a connecting surface that connects engagement surfaces of the wrench opening.
FIG. 7 is a partial view of another embodiment of the connecting surfaces that connect the engagement surfaces of the wrench opening.
FIG. 8 is illustrates another version of the wrench opening which has a twelve point construction as opposed to the six point construction illustrated in FIG. 5.
FIG. 9 illustrates a closed end wrench which incorporates a handle including at least one end connected to a wrench body having a wrench opening constructed according to the invention.

With additional reference to FIG. 5, the construction of the wrench opening 14 as described above provides greater surface-to-surface engagement with a nut or bolt head 18 to be torqued than is possible with engagement surfaces having flat surface portions as is conventional in the prior art. This provision of the surface-to-surface engagement as compared to line contact thus distributes the force and lowers the stress exerted on the corners of the nut or bolt head to thereby increase the extent of torque that can be applied by the socket.

As illustrated by continuing reference to FIG. 5, the engagement surfaces 16 have curvatures including central portions **16*c* spaced from the central axis A by a radius $R_1$. The curvature of each engagement surface 16 has a radius $R_2$ generated about an axis B that extends parallel to the central axis A at an outwardly spaced location from the socket 10. Best results are achieved when $R_1$ is in the range of about 0.06 $R_2$ to 0.40 $R_2$ since this relationship provides the greatest degree of surface-to-surface engagement of the engagement surface with a nut or bolt head when normal tolerances are involved. The most preferred relationship for providing the most preferred results are achieved when $R_1$ is about 0.2 $R_2$, i.e. the radius of curvature $R_2$ of the convex engagement surfaces 16 is about five times that of the inner radius $R_1$ between the central axis A and the smallest diameter of the wrench opening 14**.

With combined reference to FIGS. 5 and 6, the wrench opening also includes connecting surfaces 20 that extend between the engagement surfaces 16 in a tangential relationship to the engagement surfaces. The curvature of the connecting surfaces 20 as a result of this tangential relationship spaces the wrench opening from the linear junctions of the sides of the nut or bolt head 18 with a greater spacing than is present with wrench openings having planar engagement surface portions. As such, wear of the tool that forms the wrench opening 14 does not necessitate replacement until a much greater number of units have been produced than is the case with planar engagement surface portions. Furthermore, the curved construction of the connecting surfaces 20 reduces stress concentration so that a thinner wall construction for the socket can be used without unduly sacrificing the ability to transmit torque.

In the preferred construction, each of the connecting surfaces 20 as illustrated in FIG. 6 has a radius $R_3$ in the range of about 0.08 $R_1$ to 0.24 $R_1$. the most preferred relationship for the connecting surfaces 20 is when $R_3$ is about 0.16 $R_1$.

With reference to FIG. 7, in another version the wrench opening includes connecting surfaces 22 extending between the engagement surfaces 16 with each connecting surface having a curvature with a radius $R_4$ having a center at the central axis A of the wrench opening. This construction of the connecting surfaces 22 reduces the tooling cost since the tooling used to form the wrench opening can be manufactured by rotation about the central axis A to cut the tool surfaces that form the connecting surfaces.

In the wrench opening 14 illustrated in FIGS. 1 through 5, each engagement surface 16 has the central portion **16*c* extending between the end portions 16*a* and 16*b*. Six of the engagement surfaces 16** are provided with this construction of the wrench opening in a six point arrangement for torquing a hexagonal nut or bolt head.

With reference to FIG. 8, another embodiment of the socket 10 has the engagement surfaces 16 of the wrench opening 14' each provided with a recess 24 between the end portions **16*a* and 16*b*. Each of the recesses 24 receives a pair of adjacent end portions 16*a* and 16*b* of two other engagement surfaces 16. The wrench opening 14' with this construction has twelve of the engagement surfaces 16** spaced about the central axis A with alternate sets of the engagement surface portions being engageable with a hexagonal nut or bolt head to provide torquing.

As illustrated in FIGS. 1 through 4, the wrench body 12 of the socket 10 has one end 26 including a square driver opening 28 through which the central axis A extends. This square driver opening 28 has round recesses 30 (FIG. 2) on each of its four sides to permit releasable securement of the socket to a wrench by a ball detent of any conventional type. Another end 32 of the wrench body 12 defines the driver opening 14 previously described with the curved engagement surfaces for providing increased surface-to-surface engagement with a nut or bolt head to be torqued. It should be understood that either design of the connecting surface 20 or 22 can be utilized with the wrench opening which may also have either the six point arrangement illustrated in FIG. 5 or the twelve point arrangement illustrated in FIG. 8 as previously described.

With reference to FIG. 9, a closed end wrench generally indicated by 34 has a handle 36 with at least one end including a wrench body 38 with a central axis A about which the wrench is rotated. As illustrated, each end of the wrench handle 36 includes an associated wrench body 38 with the central axis about which the wrench is rotated. However, it should be understood that it is also possible for one end to be of the open end wrench type and the other end to be of the closed wrench type. Each wrench body 38 includes a wrench opening 14 with curved engagement surfaces 16 having the curvatures described in connection with the socket such that no repetition thereof is necessary. It should be appreciated that as with the socket, the wrench opening 14 of the closed end wrench 34 may have either version of the connecting surfaces 20 or 22 and may be of the twelve point construction as well as of the hexagonal six point construction specifically illustrated.

It should be appreciated that the radii $R_1$ and $R_4$ must have fixed lengths to provide the circular shapes involved. Likewise, the radii $R_2$ and $R_3$ may have fixed lengths to generate partially circular engagement and connecting surfaces. However, it is also possible for the radii $R_2$ and $R_3$ to have variable lengths with the engagement and connecting surfaces provided as elliptical, parabolic, or other continuously curved shapes.

While the best modes for carrying out the invention have been specifically disclosed, those familiar with the art to which this invention relates will recognize various alternative designs and embodiments for practicing the invention as defined by the following claims.

What is claimed is:

1. A wrench body including a wrench opening having a central axis, said wrench opening comprising: a plurality of engagement surfaces defining a closed shape and facing inwardly toward the central axis, each of said engagement surfaces having an inwardly convex shape and including opposite end portions that are continuously curved with the same curvature as each other, the engagement surfaces having curvatures including central portions spaced from the central axis by a radius $R_1$, the curvature of each engagement surface having a radius $R_2$, and $R_1$ being in the range of about 0.06 $R_2$ to 0.40 $R_2$ whereby the wrench opening provides greater surface-to-surface engagement with nuts or bolt heads to be torqued than is possible with engagement surfaces having flat surface portions.

2. A wrench body as in claim 1 wherein $R_1$ is about 0.2 $R_2$.

3. A wrench body as in claim 1 or 2 wherein the wrench opening includes connecting surfaces extending between the engagement surfaces in a tangential relationship to the engagement surfaces.

4. A wrench body as in claim 3 wherein each connecting surface has a curvature with a radius $R_3$ in the range of about 0.08 $R_1$ to 0.24 $R_1$.

5. A wrench body as in claim 4 wherein $R_3$ is about 0.16 $R_1$.

6. A wrench body as in claim 1 or 2 wherein the wrench opening includes connecting surfaces extending between the engagement surfaces, and each connecting surface having a curvature with a radius $R_4$ having a center at the central axis of the opening.

7. A wrench body as in claim 1 or 2 wherein each engagement surface has a central portion extending between the end portions thereof, and the wrench opening having six engagement surfaces extending about the central axis.

8. A wrench body as in claim 1 or 2 wherein each engagement surface has a recess between the end portions thereof, each of said recesses receiving a pair of adjacent end portions of two other engagement surfaces, and the wrench opening having twelve of the engagement surfaces spaced about the central axis.

9. A wrench body as in claim 1 or 2 wherein the curvature of the engagement surfaces is circular.

10. A wrench body as in claim 1 or 2 wherein the curvature of the engagement surfaces is elliptical.

11. A wrench body as in claim 1 or 2 wherein the curvature of the engagement surfaces is parabolic.

12. A wrench socket comprising: a wrench body having a central axis about which the socket is rotated, said wrench body having one end including a driver opening and another end including a wrench opening, a plurality of engagement surfaces facing inwardly toward the central axis to define a closed shape about the wrench opening, each of said engagement surfaces having an inwardly convex shape and including opposite end portions that are continuously curved with the same curvature as each other, the curvature of each engagement surface having a central portion spaced from the central axis by a radius $R_1$, the curvature of each engagement surface having a radius $R_2$, and $R_1$ being in the range of about 0.06 $R_2$ to 0.40 $R_2$, whereby the wrench opening of the socket provides greater surface-to-surface engagement with nuts or bolt heads to be torqued than is possible with socket engagement surfaces having flat surface portions.

13. A wrench socket comprising: a wrench body having a central axis about which the socket is rotated, said wrench body having one end including a driver opening and another end including a wrench opening, a plurality of engagement surface facing inwardly toward the central axis to define a closed shape about the wrench opening, each of said engagement surfaces having an inwardly convex shape and including opposite end portions that are continuously curved with the same curvature as each other, the curvature of each engagement surface having a central portion spaced from the central axis by a radius $R_1$, the curvature of each engagement surface having a radius $R_2$, $R_1$ being in the range of about 0.06 $R_2$ to 0.40 $R_2$ such that the wrench opening of the socket provides greater surface-to-surface engagement with nuts or bolt heads to be torqued than is possible with socket engagement surfaces having flat surface portions, the wrench opening of the socket also including connecting surfaces extending between the engagement surfaces in a tangential relationship to the engagement surfaces, and each connecting surface having a curvature with a radius $R_3$ in the range of about 0.08 $R_1$ to 0.24 $R_1$.

14. A wrench socket comprising: a wrench body having a central axis about which the socket is rotated, said wrench body having one end including a driver opening and another end including a wrench opening, a plurality of engagement surfaces facing inwardly toward the central axis to define a closed shape about the wrench opening, each of said engagement surfaces having an inwardly convex shape and including opposite end portions that are continuously curved with the same curvature as each other, the curvature of each engagement surface having a central portion spaced from the central axis by a radius $R_1$, the curvature of each engagement surface having a radius $R_2$, $R_1$ being in the range of about 0.06 $R_2$ to 0.40 $R_2$ such that the wrench opening of the socket provides greater surface-to-surface engagement with nuts or bolt heads to be torqued than is possible with socket engagement surfaces having flat surface portions, and the wrench opening of the socket also including connecting surfaces extending between the engagement surfaces and having a radius $R_4$ concentric with the radius $R_1$ about the central axis.

15. A closed end wrench comprising: a handle having one end including a closed end wrench body with a central axis about which the wrench is rotated, said wrench body including a wrench opening through which the central axis extends, a plurality of engagement surfaces facing inwardy toward the central axis to define a closed shape about the wrench opening, each of said engagement surfaces having an inwardly convex shape and including opposite end portions that are continuously curved with the same curvature as each other, the curvature of each engagement surface having a central portion spaced from the central axis by a radius $R_1$, the curvature of each engagement surface having a radius $R_2$, and $R_1$ being in the range of about 0.06 $R_2$ to 0.40 $R_2$, whereby the wrench opening of the closed end wrench provides greater surface-to-surface engagement with nuts or bolt heads to be torqued than is possible with closed end wrench engagement surfaces having flat surface portions.

16. A closed end wrench comprising: a handle having one end including a closed end wrench body with a central axis about which the wrench is rotated, said wrench body including a wrench opening through which the central axis extends, a plurality of engagement surfaces facing inwardly toward the central axis to define a closed shape about the wrench opening, each of said engagement surfaces having an inwardly convex shape and including opposite end portions that are continuously curved with the same curvature as each other, the curvature of each engagement surfaces having a central portion spaced from the central axis by a radius $R_1$, the curvature of each engagement surface having a radius $R_2$, $R_1$ being in the range of about 0.06 $R_2$ to 0.40 $R_2$ such that the wrench opening of the closed end wrench provides greater surface-to-surface engagement with nuts or bolt heads to be torqued than is possible with closed end wrench engagement surfaces having flat surface portions, the wrench opening of the closed end wrench including connecting surfaces extending between the engagement surfaces in a tangential relationship to the engagement surfaces, and each connecting surface having a curvature with a radius $R_3$ in the range of about 0.08 $R_1$ to 0.24 $R_1$.

17. A closed end wrench comprising: a handle having one end including a closed end wrench body with a central axis about which the wrench is rotated, said wrench body including a wrench opening through which the central axis extends, a plurality of engagement surfaces facing inwardly toward the central axis to define a closed shape about the wrench opening, each of said engagement surfaces having an inwardly convex shape and including opposite end portions that are continuously curved with the same curvature as each other, the curvature of each engagement surface having a central portion spaced from the central axis by a radius $R_1$, the curvature of each engagement surface having a radius $R_2$, $R_1$ being in the range of about 0.06 $R_2$ to 0.40 $R_2$ such that the wrench opening of the closed end wrench provides greater surface-to-surface engagement with nuts or bolt heads to be torqued than is possible with closed end wrench engagement surfaces having flat surface portions, and the wrench opening of the closed end wrench including connecting surfaces extending between the engagement surfaces and having a radius $R_4$ concentric with the radius $R_1$ about the central axis.

* * * * *

UNITED STATES PATENT AND TRADEMARK OFFICE

CERTIFICATE OF CORRECTION

PATENT NO. : 4,598,616

DATED : July 8, 1986

INVENTOR(S) : David S. Colvin

It is certified that error appears in the above-identified patent and that said Letters Patent is hereby corrected as shown below:

Column 6, line 37, claim 13
"surface" should be --surfaces--.

Signed and Sealed this

Twenty-first Day of October, 1986

[SEAL]

*Attest:*

DONALD J. QUIGG

*Attesting Officer*

*Commissioner of Patents and Trademarks*